US005950639A

United States Patent [19]

Suzuki et al.

[11] Patent Number: 5,950,639

[45] Date of Patent: Sep. 14, 1999

[54] AIRTIGHT COMPACT FOR COSMETICS

[75] Inventors: Kazuo Suzuki; Masahiro Sumise, both of Tokyo, Japan

[73] Assignees: Yoshino Kogyosho Co., Ltd; Kose Corporation, both of Tokyo, Japan

[21] Appl. No.: 09/125,120

[22] PCT Filed: Oct. 3, 1997

[86] PCT No.: PCT/JP97/03554

§ 371 Date: Aug. 10, 1998

§ 102(e) Date: Aug. 10, 1998

[87] PCT Pub. No.: WO98/25497

PCT Pub. Date: Jun. 18, 1998

[51] Int. Cl.[6] ..... A45D 33/24

[52] U.S. Cl. ..... 132/294; 132/300

[58] Field of Search ..... 132/294, 300, 132/293; 206/581; 220/DIG. 26

[56] References Cited

U.S. PATENT DOCUMENTS

| | | | |
|---|---|---|---|
| 1,959,629 | 5/1934 | Kasdan | 132/293 |
| 2,054,004 | 9/1936 | Sandberg | 132/293 |
| 2,078,096 | 4/1937 | Parkin | 132/294 |
| 5,353,818 | 10/1994 | Suzuki et al. | 132/294 |

FOREIGN PATENT DOCUMENTS

| | | | |
|---|---|---|---|
| U-3-911 | 1/1991 | Japan . | |
| U-3-34412 | 4/1991 | Japan . | |
| U-3-123416 | 12/1991 | Japan . | |
| A-4-55945 | 2/1992 | Japan . | |
| U-4-64309 | 6/1992 | Japan . | |
| U-7-3510 | 1/1995 | Japan . | |
| 8-242937 | 9/1996 | Japan | 132/300 |
| 422969 | 1/1935 | United Kingdom | 132/294 |

*Primary Examiner*—Todd E. Manahan
*Attorney, Agent, or Firm*—Oliff & Berridge, PLC

[57] ABSTRACT

In an airtight compact for a cosmetic, a main container member (1) is formed such that an inner frame member (3), which has a storage portion (14) for a cosmetic implement and an accommodation portion for an inner dish (5), is fitted and fixed within a outer frame member (2). The outer frame member has a shallow container shape with a catch wall (6) on a front surface wall thereof and a protuberant catch strip (6*a*) which engages with an outer lid member (9) and a sliding surface (6*b*) along which a release-activating piece (13) is slidable. An inner dish (4), which has a peripheral resilient sealing member about the opening thereof, is fitted firmly into the inner-dish accommodation portion of the inner frame member. A lid assembly is formed such that an inner side of the outer lid member (9) is integrally provided with an inner lid member (7) for sealing the inner dish, where the inner lid member is formed with a catch protrusion (7*a*) on a front edge portion thereof and a hinge (18) for connection to the outer frame member on a rear edge portion thereof. The binge (18) is connected in such a manner that the lid assembly is linked in a freely openable manner to a rear edge portion of the outer frame member (2) of the main container member. A catch piece (10) is disposed perpendicularly at a front edge portion of the outer lid member (9) and is provided with a catch protrusion (10*a*) that engages with the protuberant catch strip (6*a*) of the outer frame member (9). A hook piece (11) is disposed perpendicularly on an inner surface of a central portion of the outer lid member so as to engage with the catch protrusion (7*a*) of the inner lid member and the release-activating piece (13) at the front edge portion of the outer lid member is attached thereto in a rotational manner.

11 Claims, 5 Drawing Sheets

AIRTIGHT COMPACT FOR COSMETICS

DETAILED DESCRIPTION OF THE INVENTION

1. Technical Field

The present invention relates to a compact for a cosmetic substance which is provided with a lid assembly comprising an inner lid member that seals an inner dish containing a cosmetic substance and an outer lid member that doses the entire compact, and, in particular, to a compact for a cosmetic substance having a closable structure whereby pressure from the inner lid causes a resilient sealing member provided on an edge portion of an opening of the inner dish to form a double airtight state.

2. Background Art

As can be seen from Japanese Utility Model Application Laid-Open No. 7-3510, which discloses a typical example of a compact for a cosmetic substance, a known type of compact for a cosmetic substance has a configuration comprising a main compact body having an outer shape that is roughly rectangular or oval, wherein a concave portion into which is assembled an inner dish that accommodates a cosmetic substance is provided in one side half thereof and another concave portion that accommodates a cosmetic implement such as a powder puff is provided in the remaining side half. A lid assembly formed of an inner lid member that seals the surface of the inner dish and an outer lid member that doses the entire compact is provided on one edge portion of the compact, to form a hinged structure that can be freely opened and closed.

Either of the following methods is employed as means of releasing the lid assembly: (1) a method of releasing both the inner and outer lid members together by a "one-touch" operation, such that the engagement between the outer lid member and the main body of the compact is canceled whereby, at the same time, the engagement between the inner lid member and the inner dish is canceled, or (2) a method of releasing the inner lid member after the outer lid member has been completely released.

However, method (1) has a problem in that a large operating force is required for releasing the lid assembly, because the disengagement of both of the lid members must be done simultaneously, and method (2) has a problem in that the operation of releasing the lids is complicated, because each lid member requires a separate release operation.

In addition, there are many various volatile substances comprised within cosmetic substances, so a compact that is designed to hold such a cosmetic substance has to have a structure that is capable of being closed so that the cosmetic substance contained therein is in a sealed state, to ensure that such volatile substances do not evaporate.

Specific examples of such a structure are known, as disclosed in Japanese Utility Model Application Laid-Open Nos. 3-34412 and 7-3510.

In the former configuration, disclosed in Japanese Utility Model Application Laid-Open No. 3-34412, an inner dish is provided fitted into an inner accommodation portion formed in a main container body and a sealing member consisting of a resilient material is attached to the inner surface of a lid body of the main container body. The vicinity of the peripheral edge portion of this sealing member is formed to have an inward-facing tapered surface on an outer surface of an annular skirt portion that protrudes so as to engage with the peripheral edge of the opening of the inner dish.

When the container is closed, the skirt portion of the sealing member engages inward of the inner dish from the upper opening thereof, and the outer surface of the skirt portion is pressed elastically into contact with the inner peripheral edge of the opening of the inner dish, to form an airtight seal for the interior of the inner dish. However, this configuration in which the skirt portion of the sealing member is inserted into the inner dish when the container is closed has a disadvantage in that only a limited quantity of cosmetic substance can be placed in the inner dish, to ensure that the extreme edge portions of the skirt portion do not strike the upper surface of the cosmetic substance.

In the latter configuration, disclosed in Japanese Utility Model Application Laid-Open No. 7-3510, an inner dish is fitted into and fixed to an inner frame member that is fixed to an outer frame member of a main container body, and also a flange portion is provided on an upper portion of the inner dish. A sealing member which is formed of a resilient material and which is provided on an inner surface of an inner lid (lid member) is installed so that it is brought into contact with this flange portion in an airtight manner.

With this configuration the sealing member does not protrude into the inner dish as it does in the former configuration, so the quantity of cosmetic substance that is contained therein is not limited, but this sealing structure only has one annular airtight contact portion between the flange portion of the inner dish and the sealing member, which is not sufficient from the airtightness viewpoint.

In another known configuration for an airtight container, disclosed in Japanese Patent Publication No. 4-55945, an inner member for accommodating a cosmetic substance which fits into a concave portion formed in a base member of a main container body is formed by a base portion and side walls that are set up on this base portion. A flange portion, which is provided with a thin wall that extends above upper edges of these side walls and thin libs that are orientated downward, is formed integrally and is pressed by a lid member to close the structure in an airtight manner.

However, if the entirety of this dish member of an integral form is made of a resilient material such as an elastomer, careful attention is necessary during the fabrication process and there are problems with the stability of the final form. Nevertheless, if it is made of an ordinary synthetic resin material it is difficult to adjust the shape and thickness of the flange portion, and the reliability of the sealing capabilities thereof cannot be guaranteed.

In a compact fabricated as described above, components such as the inner frame member and the inner dish are generally formed of a hard resin material, so that extremely severe demands are placed on the dimensional precision of the fabrication of the mutually fitting portions when these hard components are fitted and fixed together.

In addition, if the dimensions of the fit between the inner dish and the inner frame member are even slightly too tight, it will be difficult to fit them together during the assembly, and it is even possible that assembly will be impossible. If the dimensions of the fit are too loose, the inner dish will rattle and may fall out.

SUMMARY OF THE INVENTION

The present invention was devised in order to solve these problems in the art. An objective thereof is to provide an extremely airtight compact for a cosmetic substance such that, when the compact is in use, it is not necessary to use a large operating force to release a lid assembly which is provided with an outer lid member and an inner lid member, so that the lids can be released by a small force and moreover with a simple "one-touch" operation.

A further objective is to provide an airtight compact for a cosmetic substance wherein the quantity of the cosmetic substance contained within the inner dish of the compact is not limited and also the reliability of the seal is high, the compact can be assembled easily without necessitating a high level of fabrication precision, and the cost thereof can be reduced.

In order to achieve the above objectives, the compact of the present invention has the configuration described below, ensuring that an airtight lid assembly comprising an outer lid member and an inner lid member can be released easily by a "one-touch" operation using a small force.

In other words, the compact is configured such that: an inner frame member provided with an inner-dish accommodation portion and a cosmetic-implement storage portion is fitted and fixed within an outer frame member in which is formed a catch wall provided with a protuberant catch strip on an upper edge portion of an peripheral wall surface on a front wall side of an opening of the compact, for engaging with a lid member, to form a main container member; an inner dish containing a cosmetic substance is installed into the inner-dish accommodation portion of the inner frame member; an inner lid member for closing the inner dish, which is provided with a catch protrusion on a front edge portion and a hinge for connection to the outer frame member on a rear edge portion, is connected to the main container member in an openable manner together with an outer lid member for closing the main container, where a rear edge portion of the outer lid member is provided with a hinge for connection to the outer frame member; a catch piece, which is provided with a catch protrusion that engages with the protuberant catch strip of the outer frame member, and a hook piece, which engages with the catch protrusion of the inner lid member, are provided perpendicularly on an inner surface of the outer lid member; and an operation piece for releasing the lid assembly is provided on a front edge portion of the outer lid member; whereby, when the lid assembly is to be released, the engagement between the protuberant catch strip of the main container member and the catch piece of the outer lid member is first released, then the hook piece of the outer lid member engages with the catch protrusion of the inner lid member to pull the inner lid member.

To ensure that the quantity of cosmetic substance that is contained in the inner dish of the compact of the above configuration is not limited, and also ensure a high level of sealing of the inner-dish portion, the present invention also employs a resilient sealing member of a characteristic shape as means for sealing a peripheral edge portion of an opening of the inner dish containing the cosmetic substance.

The resilient sealing member is fixed to the peripheral edge portion of the opening of the inner dish containing the cosmetic substance, which is installed in the inner-dish accommodation portion of the inner frame member of the main container member, to be in close contact with the inner surface of the inner lid member; a skirt portion is provided on the sealing member so as to project annularly outward therefrom; a space portion is provided below the sealing member to permit only the skirt portion to be compressed and bent downward by the inner lid member; whereby the sealing state of the lid assembly that is connected to the main container member in an openable manner can be ensured when it is closed, by the compression and elastic deformation of the sealing member at two places, by the inner lid member, which is provided on an inner side of the outer lid member and which is provided with an annular compression protrusion portion that is pressed into contact with an upper surface of the sealing member and an annular peripheral wall portion that is pressed into contact with an outer surface of an extreme edge of the skirt portion.

The resilient sealing member fixed to the peripheral edge portion of the opening of the inner dish, which is accommodated in the inner-dish accommodation portion of the inner frame member of the main container member and contains the cosmetic substance, comprises a skirt portion that is attached to the upper peripheral surface of the opening and projects annularly outward, a vertical piece provided on a lower surface of the skirt portion, and a protuberant engagement portion provided extending along the side surface of the inner dish from an upper edge of the vertical piece; and it is formed annularly over a seating and a step portion at the intersection between an upper surface and a side surface of the inner frame member; thus it enables a resilient connection when the inner dish containing the cosmetic substance is fitted into the inner surface of the inner frame member and, when the lid assembly that is connected in an openable manner to the main container member is closed, the sealing member is compressed by the inner lid member to ensure a sealing state.

This facilitates assembly without necessitating strict fabrication precision of the inner frame member and the inner dish, and without any rattling, so the compact can be fabricated inexpensively and also a high level of sealing can be ensured.

BEST MODE FOR CARRYING OUT THE INVENTION

Figure 1A:
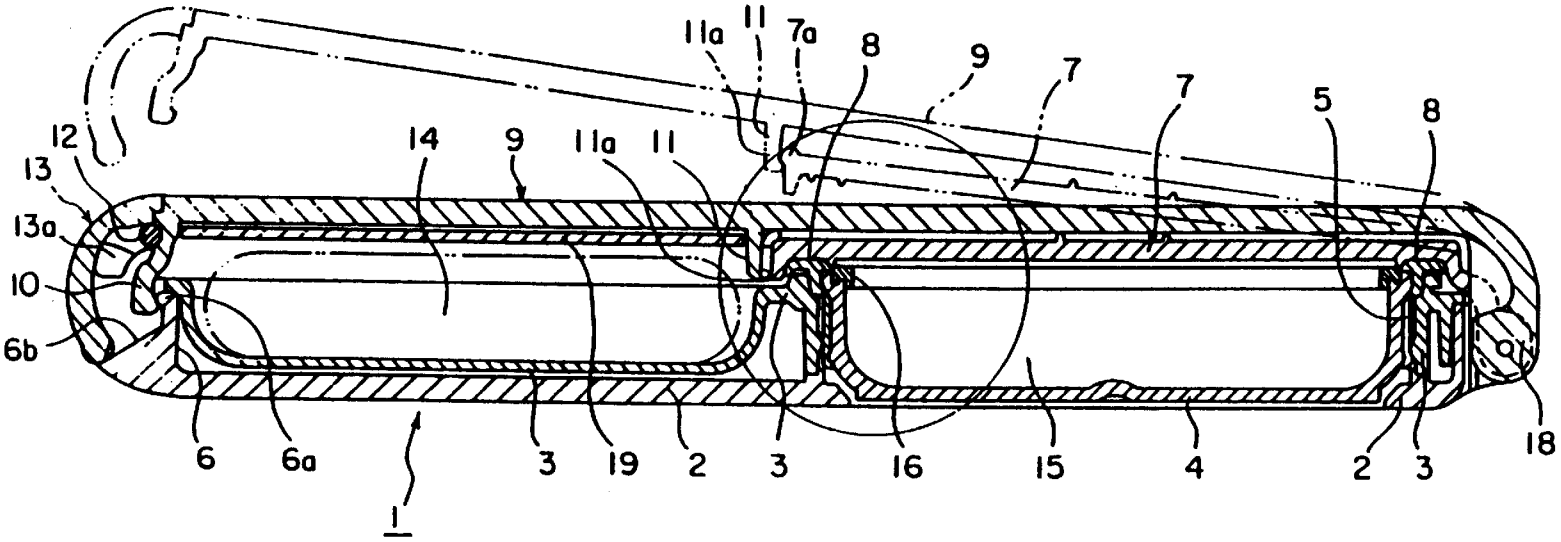
FIG. 1A shows a compact container provided with an openable lid of a "one-touch" style in accordance with this invention, being a cross-sectional view taken along the line X—X of FIG. 2.

In the compact of this invention, an inner dish 4 filled with a cosmetic substance is fitted into a main container member 1 in a state in which an inner lid member 7 and an outer lid member 9 are open, as shown by broken lines in FIG. 1A. If this lid assembly is then pressed in a direction to close it, a catch protrusion 10*a* on an extreme edge portion of a catch piece 10 that is provided on a front edge portion of the outer lid member 9 engages with a protuberant catch strip 6*a* of an outer frame member 2, and also a sealing member 8 that is provided on a peripheral edge portion of an opening of the inner dish 4 is crimped by a pressuring portion of an inner peripheral surface of the inner lid member 7 to close the assembly in a sealed state, as shown by solid lines. At this point, a protrusion 11*a* of a hook piece 11 on a central portion of an inner surface of the outer lid member 9 is positioned in a state such that a predetermined spacing is left below a catch protrusion 7*a* of the inner lid member 7.

When the compact is to be opened for use, pressing a lower portion of a release-activating piece 13 towards the main body of the compact causes that release-activating piece to rotate inward about the axis of a pin 12 provided in a front edge portion of the outer lid member 9. As a far end portion thereof slides over an inclined sliding surface 6*b* and thus moves upward, the catch piece 10 is pushed upward thereby to move the outer lid member 9 slightly upward, so that the engaged state between the catch protrusion 10*a* at the end portion of the catch piece 10 and the protuberant catch strip 6*a* of the outer frame member 2 is released and thus the outer lid member is released.

If the outer lid member 9 is moved further upward at that point, the protrusion 11*a* of the hook piece 11 engages with the catch protrusion 7*a* of the inner lid member 7 and pulls the inner lid member 7 upward, so that the lid assembly is fully released Embodiments of this invention will be described in more detail below, with reference to the accompanying drawings.

Figure 1B:
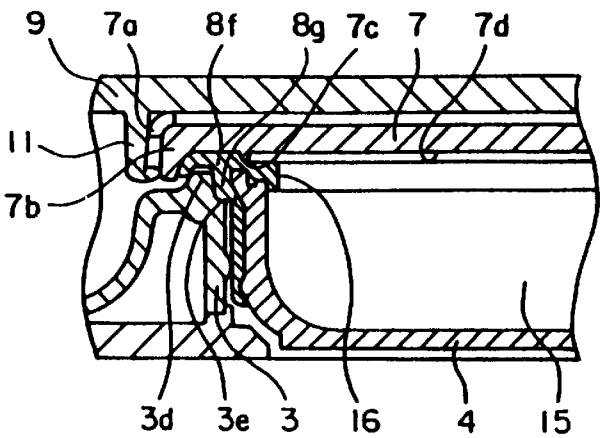
FIG. 1B is a partial expanded view thereof.
Figure 2:
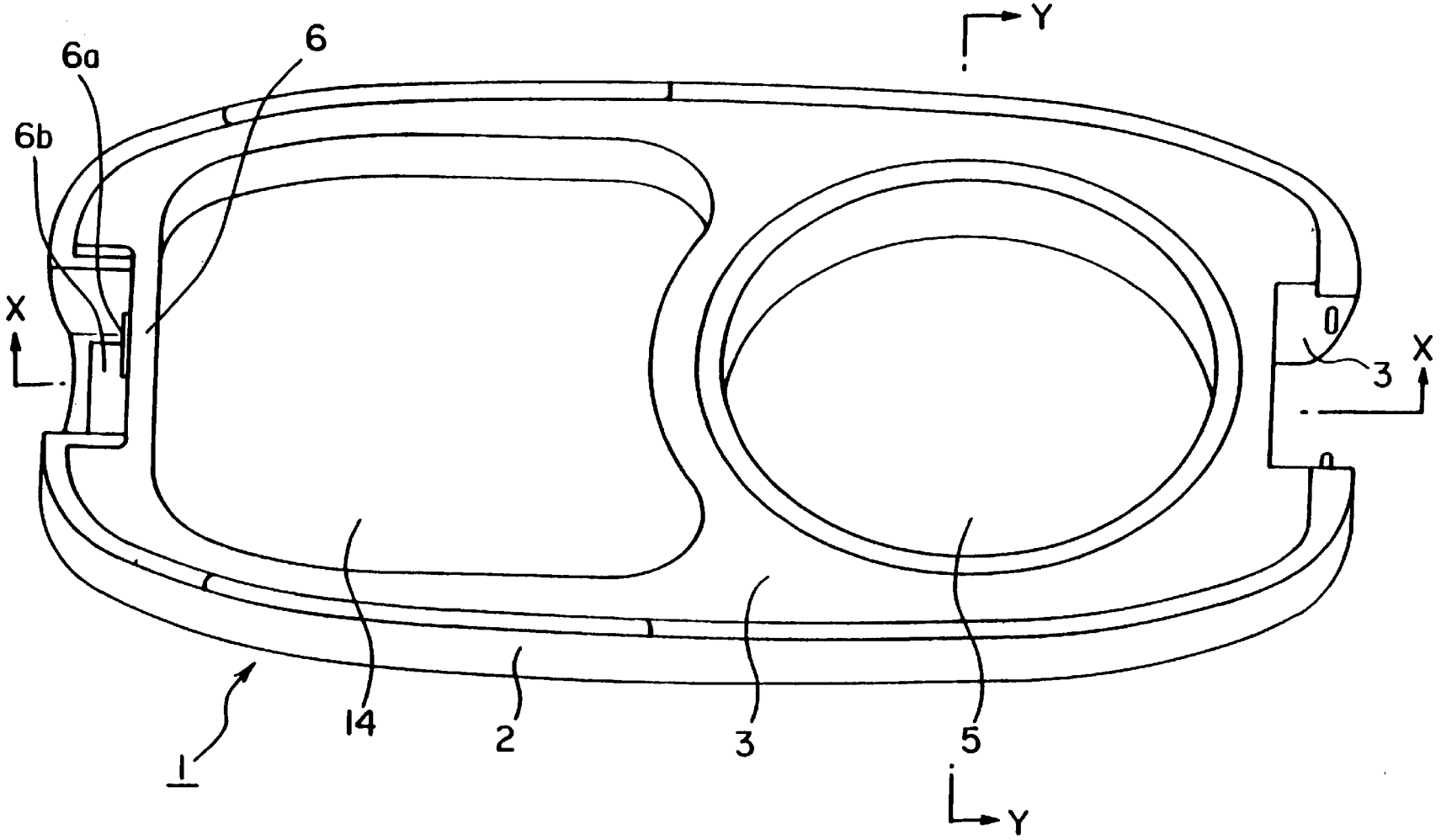
FIG. 2 is a perspective view of the main container member where the lid assembly of the compact has been removed.

The main container member 1 of a first aspect of this invention is configured as shown in FIGS. 1 and 2. In it is formed the catch wall 6 that is provided with the protuberant catch strip 6*a*, which engages with the outer lid member 9 on an outer surface of a front wall of the outer frame member 2 that defines a roughly rectangular or oval-shaped shallow container with a base, and the inclined sliding surface 6*b* over which the release-activating piece 13 slides. In addition, a connective portion that links together the lid members is formed in a rear wall portion of the outer frame member 2, a storage portion 14 for a cosmetic implement is provided in a front portion of the outer frame member 2, an accommodation portion 5 in which is contained a cosmetic substance 15 is provided in a rear portion thereof, and inner frame members 3 that are provided on each of these storage portions are fitted into and are integrally fixed to the main container member 1.

A lid assembly, which is provided with the inner lid member 7 and the outer lid member 9 with a mirror 19 on an inner surface thereof and which also has a hinge 18 protruding therefrom, is connected by a freely openable hinge connection to one edge of the rear wall portion of the outer frame member 2 of the main container member 1. An implement such as a powder puff is accommodated in the storage portion 14 for a cosmetic implement in the inner frame member 3 and also the inner dish 4 which accommodates the cosmetic substanc 15 in the accommodation portion 5 for the inner dish is fitted and fixed therein, to complete the configuration of the cosmetic compact.

Note that components such as the outer frame member, the inner frame member, and the lid members could be made by an injection fabrication means of a generally-used synthetic resin.

The outer lid member 9 is constructed such that the catch piece 10 having the catch protrusion 10*a* at an end portion thereof is provided on a front inner wall surface directly opposite to the protuberant catch strip 6*a* of the outer frame member 2 that engages therewith, and also the hook piece 11 in which is formed the protrusion 11*a* that engages with the catch protrusion 7*a* of the inner lid member 7 is provided on a central inner wall surface thereof.

The pin 12 that supports the release-activating piece 13 is suspended horizontally in the lateral direction on a front end portion of the catch piece 10 of the outer lid member 9, an upper portion of the release-activating piece is attached rotationally to that pin, and also an extreme end portion of the release-activating piece 13 is placed in close contact with the sliding surface 6*b* on the front wall of the outer frame member 2, so that it can slide therealong. A blocking piece 13*a* is also provided protruding from the inner surface of the release-activating piece 13.

The sealing member 8, which consists of a resilient material formed to be T-shaped in section, is provided between the peripheral wall of the opening of the inner-dish accommodation portion 5 of the inner frame member 3 and an outer peripheral portion of the opening of the inner dish 4. This sealing member 8 is attached so as to cover the peripheral surface of the inner dish and the peripheral surface of the inner frame member. Providing the extreme edge portion thereof in such a manner that it curves slightly downward at an angle makes it possible to crimp the sealing member 8 by the annular peripheral wall portion 7*b* and the compression protrusion portion 7*c* that are provided on the peripheral portion of the inner lid member 7 on the inner surface of the outer lid member 9 when the lids are closed, to close it in a sealed state. The inner dish 4 filled with the cosmetic substance 15 is fitted into the inner-dish accommodation portion 5 of the inner frame member 3 of the main container member 1 of the above described configuration, and a cosmetic implement such as a powder puff is accommodated in the storage portion 14 for the cosmetic implement, to complete the airtight compact for a cosmetic substance.

A decorative ring 16 made of a soft synthetic resin or the like is provided around the inner peripheral edge of the opening of the inner dish 4, but not just for appearance; it also acts as a support member during the stretching of a mesh member.

The description now turns to the sealing mechanism of this compact.

As shown in FIG. 1, the inner lid member 7 provided on the inner surface of the outer lid member 9 comprises a flat portion 7*d* having a diameter slightly larger than that of the opening of the inner dish, an annular peripheral wall portion 7*b* that extends downward from an outer peripheral portion of that flat portion, and an annular compression protrusion portion 7*c* on the inner side of that peripheral wall portion. The catch protrusion 7*a* that comes into contact with the protrusion 11*a* of the hook piece 11 of the outer lid member 9 and can engage therewith is provided on a front upper edge portion of the annular peripheral wall portion 7*b*. A rear edge portion of the inner lid member 7 is hinged to the outer frame member 2 by the same shaft as the hinge 18 of the outer lid member 9, to complete the openable lid assembly.

When the lid assembly of the above described compact has been closed so that the compact is in a closed-lid state, the sealing member 8 provided on the peripheral portion of the opening of the inner dish 4 is compressed by the airtight compression portions formed by the annular compression protrusion portion 7*c* and the annular peripheral wall portion 7*b* so as to be pincered therebetween, and thus the sealing member of the peripheral portion of the opening is sealed by a double structure of the inner lid member 7.

When an attempt is made to release the lid assembly and open the compact, if the outer lid member 9 is released by pressing with a finger tip on the release-activating piece 13 to operate it, the engagement between the protuberant catch strip 6*a* of the outer frame member 2 and the catch protrusion 10*a* of the catch piece 10 of the outer lid member 9 is released, then the protrusion 11*a* of the hook piece 11 of the outer lid member 9 engages with the catch protrusion 7*a* to pull the inner lid member 7 upward, so that the sealed state of the inner lid member 7 and the inner dish 4 is released and the lid assembly is opened.

Figure 3A:
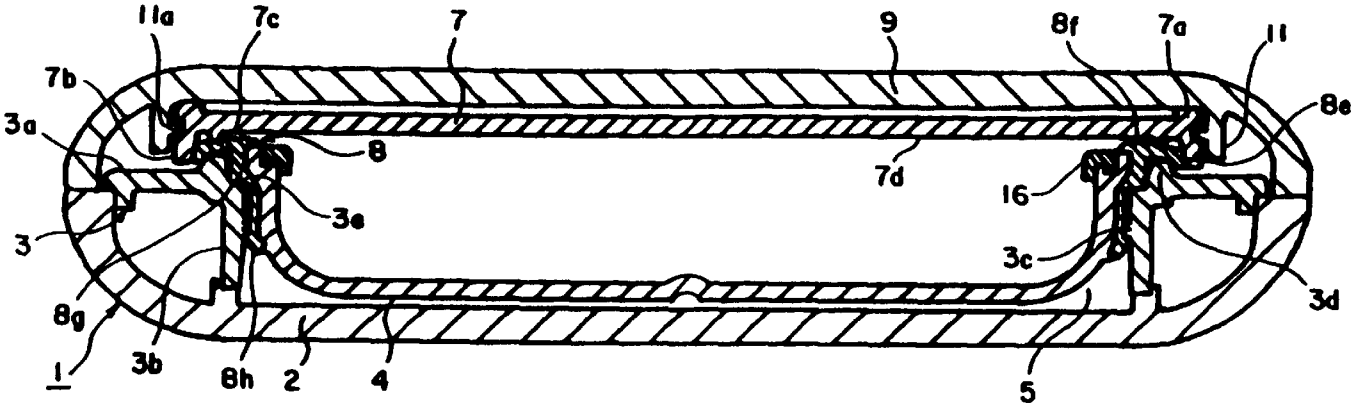
FIG. 3A shows the sealed state of the inner dish of a second embodiment of the present invention when the lid assembly is closed, being a cross-sectional view taken along the line Y—Y of FIG. 2.
Figure 3B:
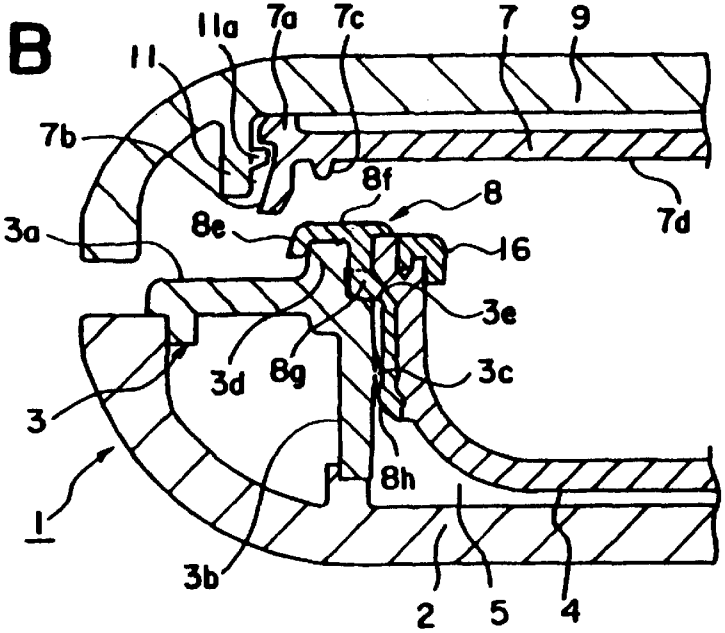
FIG. 3B is a partial expanded view of a released state thereof.

In the above described compact for a cosmetic substance, the structure of the lid assembly and the sealing member 8 provided around the peripheral portion of the opening of the inner dish 4 ensures that the configuration shown in FIG. 3 enables a higher degree of airtightness when the lids of the compact are closed to form a sealed state. In addition, the inner frame member 3 and the inner dish 4 can be assembled correctly and easily, even if the fabrication precision thereof is somewhat low.

A step portion 3*e* is provided at an intersection between a horizontal portion 3*a* and a vertical portion 3*b* of the inner frame member 3, which is fixed to the outer frame member 2 of the main container member 1, an annular seating 3*d* that protrudes higher than the horizontal portion is provided on an outer side of this step portion, and also a plurality of catch protrusions 3*c* that fix the inner dish 4 are provided at a predetermined spacing in the peripheral direction around an inner peripheral surface of the vertical portion 3*b*.

The sealing member 8, which is formed of a resilient material such as an elastomer and is disposed on the peripheral portion of the opening of the inner dish 4, is provided with a vertical piece 8*g* that engages with the step portion 3*e* of the inner frame member 3 and an annular skirt portion 8*f* that is positioned on the upper surface of the annular seating 3*d* of the inner frame member 3 and projects outward. The configuration is such that an extreme edge portion 8*e* of his annular skirt portion 8*f* is curved slightly downward at a slant, and is provided in such a manner that it is integrated with the side surface of the inner dish 4.

If necessary, if a space portion 17 is provided between the annular skirt portion 8*f* and the annular seating 3*d* by curving the annular skirt portion 8*f* slightly downward, as in the first embodiment, the annular skirt portion 8*f* can be easily compressed and deformed by the inner lid member 7 when the lid assembly is closed, which makes it possible to further improve the sealing capability thereof.

With the above described configuration in which the sealing member 8 is provided integrally on the outer peripheral surface of the inner dish 4, a method can be applied in which the inner dish of a predetermined shape is first set into a die for the fabrication of the sealing member, then the necessary sealing member is formed by injecting into the die a resilient material such as an elastomer that is to form the sealing member, to produce an insert in which the inner dish and the sealing member are integrated.

The inner dish 4, which is provided with the sealing member 8 around the peripheral portion of the opening thereof in the above configuration, can be made to engage in a simple manner with the inner side surfaces of the vertical portion 3*b* of the inner frame member 3 by inserting the base portion thereof into an opening portion of the inner-dish accommodation portion 5 of the inner frame member 3, then pressing the inner dish 4 downward.

During the assembly, a protuberant engagement portion 8*h* provided on a lower edge portion of the sealing member 8 is deformed elastically by pressure forces to absorb any slight dimensional errors caused during the fabrication of components such as the inner frame member 3, the inner dish 4, and the sealing member 8, so that the inner dish 4 can be fixed securely in the inner frame member 3 and, moreover, the inner dish 4 does not rattle.

The strict fabrication precision that is required in the prior art during the fabrication of components such as the inner frame member, the inner dish, and the sealing member is therefore no longer necessary.

When the lid assembly is closed in the compact of the above described configuration, the annular compression protrusion portion 7*c* of the inner lid member 7 presses against the upper surface of the base of the skirt portion 8*f* of the sealing member 8, forcing the skirt portion to deform elastically and be bent downward.

If the inner peripheral surface of the annular peripheral wall portion 7*b* of the inner lid member 7 is formed so as to press against the outer side surface of the extreme edge portion 8*e* of the sealing member 8, the annular peripheral wall portion 7*b* and the annular seating 3*d* of the inner lid member work together to compress the extreme edge portion 8*e* of the sealing member 8, enclosing the cosmetic substance within the inner dish 4 in a double airtight state, which greatly increases the airtightness thereof.

As a result of the compact having the above described configuration, the present invention ensures that the annular airtight contact portion that is in contact with the annular compression protrusion portion 7*c* of the inner lid member 7 and the annular airtight contact portion that is in contact with the annular peripheral wall portion 7*b* thereof are formed as two parallel strips to create a double sealing structure, so that the volatile components of the cosmetic substance accommodated within the inner dish do not evaporate and thus the reliability of the airtight seal is greatly increased, provided the two airtight contact portions do not fail simultaneously.

In particular, the annular airtight contact portion created by the annular peripheral wall portion 7*b* is formed by the pincering of the extreme edge portion 8*e* of the sealing member 8 between the annular peripheral wall portion 7*b* and the annular seating 3*d*, so the contact pressure thereof is extremely high and thus it is extremely unlikely that the airtight seal will fail.

The configuration need not necessarily be such that the outer surface of the extreme edge portion 8*e* of the sealing member 8 is compressed by the annular peripheral wall portion 7*b* of the inner lid member 7, as described above. Since the annular skirt portion 8*f* of the sealing member 8 of the present invention is pincered between the annular compression protrusion portion 7*c* of the inner lid member 7 and the annular seating 3*d* of the inner frame member, the cosmetic substance within the inner dish 4 can be maintained in a highly airtight state.

Figure 4A:
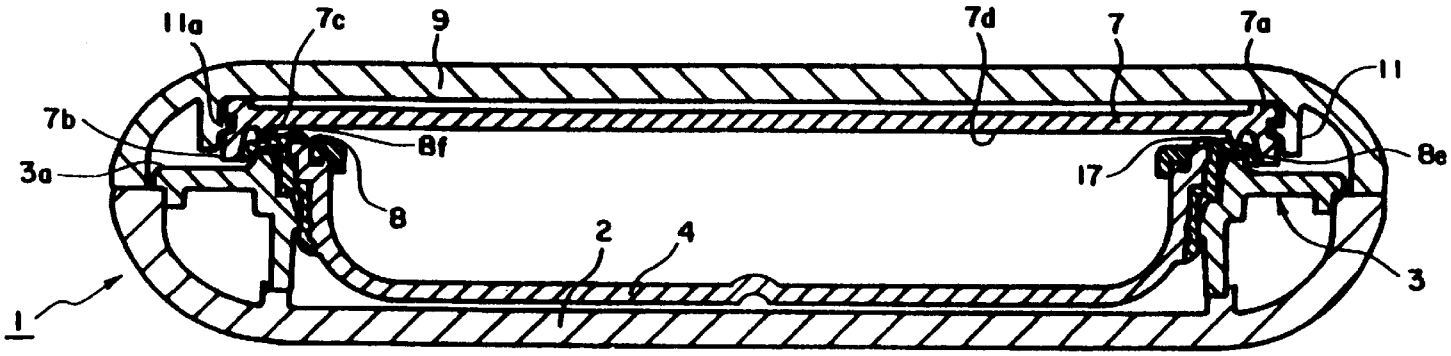
FIG. 4A shows a third embodiment of the present invention with the inner dish thereof in a closed state and FIG. 4B shows a partial expanded view of a released state thereof.
Figure 4B:
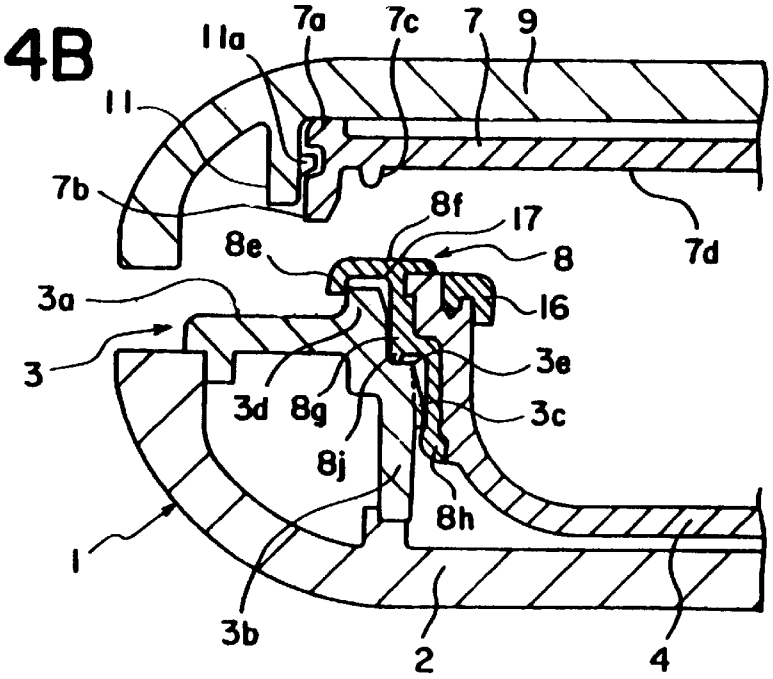

In addition, the configuration of the present invention, which ensures that the sealing member 8 readily deforms elastically, as shown in FIG. 4, makes it possible to provide an even greater effect of absorbing any dimensional error that may be present in components such as the inner frame member, the inner dish, and the sealing member.

In other words, the configuration could be such that a projection 8*j* is formed to protrude downward from the base portion of the vertical piece 8*g* of the sealing member 8 used in the compact shown in FIG. 3, an extreme edge surface of this projection 8*j* is pressed into contact with the flat surface of the step portion 3*e* of the inner frame member 3, as shown in FIG. 4, and the sealing member 8 is fitted between the inner frame member 3 and the inner dish 4 so that the inner dish 4 is fixed thereby.

When the inner dish 4 is installed into the inner frame member 3 of the compact of this embodiment shown in FIG. 3, the protuberant engagement portion 8*h* of the sealing member 8 deforms elastically to absorb dimensional errors, mainly in the lateral direction. However, when the inner dish 4 is installed into the inner frame member 3 of the compact using the sealing member 8 provided with the projection 8*j*, as shown in FIG. 4, in addition to the deformation of the protuberant engagement portion 8*h*, the projection 8*j* also deforms elastically to absorb dimensional errors in the vertical direction as well.

Since the above described sealing member 8 that is provided with the projection 8*j* attached to the base portion of the vertical piece 8*g* is more ready to deform elastically than the sealing member 8 provided only with the protuberant engagement portion 8*h*, a compact in which is used the sealing member of FIG. 4 is even more effective than one using the sealing member shown in FIG. 3 at absorbing errors in the fabrication dimensions that occur in components such as the inner frame member 3 and the sealing member 8.

In the above described compact, the sealing member provided around the peripheral edge portion of the o peripheral edge portion of the opening of the inner dish is formed in a configuration wherein the vertical piece 8*g*, which is in contact with the step portion 3*e* formed in the inner frame member 3, is provided in the base portion of the outward-projecting annular skirt portion 8*f* that is positioned on the upper surface of the annular seating 3*d* of the inner frame member 3.

In addition, the configuration is such that the projection 8*j* protrudes downward from the base portion of the vertical piece 8*g*, and the lower edge surface of this projection is in contact with the surface of the step portion 3*e* of the inner frame member 3. Thus the sealing member has the capability of absorbing fabrication dimensional errors in components such as the inner frame member 3 and the inner dish 4, as well as absorbing pressure forces in a three-dimensional manner during assembly, in addition to improving the sealing state of the compact. This also makes it extremely easy to assemble the compact.

However, if the main objective is merely to improve the sealing state, the sealing member 8 provided around the peripheral edge portion of the opening of the inner dish 4 can ensure a good sealing state for the compact, even if it has the simpler configuration described below.

Figure 5A:
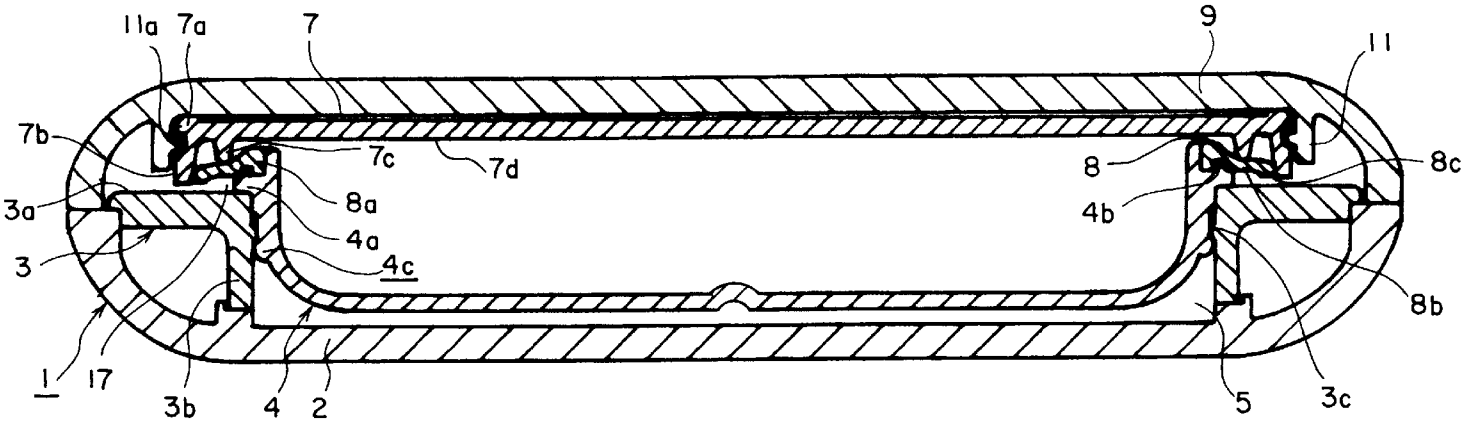
FIG. 5A shows a fourth embodiment of the present invention with the inner dish thereof in a closed state and FIG. 5B shows a partial expanded view of a released state thereof.
Figure 5B:
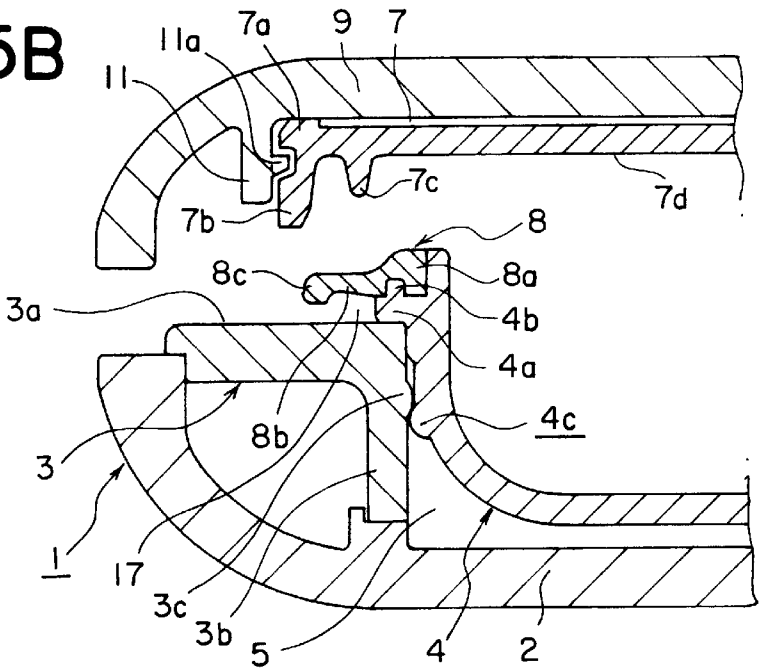

An annular flange portion 4*a* that projects outwards is formed around the outer peripheral edge of the opening of the inner dish 4, which fits into the inner-dish accommodation portion 5 of the inner frame member 3 which in turn fits into and is fixed to the outer frame member 2 of the main container member 1, an annular projection portion 4*b* is formed on an upper surface of this flange portion, and the annular sealing member 8 consisting of a resilient material is fixed onto the upper surface of the flange portion, as shown in FIG. 5. This forms a sealed portion that ensures that the cosmetic substance within the inner dish 4 is held in a sealed state by the pressure of the inner lid member 7.

The thus-configured sealing member 8 is fabricated in such a manner that the projection portion 4*b* of the flange portion fits into the rear surface thereof, a base portion 8*a* is fixed so that it is held between the periphery of the inner dish and the annular projection portion 4*b*, a skirt portion 8*b* is also formed projecting outward from that base portion, and an extreme edge portion & curves slightly downward. The provision of a small space portion 17 between the extreme edge portion 8*c* of the sealing member 8 and the horizontal portion 3*a* of the inner frame member 3 ensures that, when the lids of the container are closed, the extreme edge portion 8*c* of the sealing member 8 that is pressed by the inner lid member 7 can be bent downward, before the lid assembly of the container is closed to put the inner-dish portion that contains the cosmetic substance into a sealed state.

To fabricate the sealing member of the above described configuration, it is optimal to make an insert in which the inner dish and the sealing member formed of a resilient material are integrated, but a method could also be used whereby the sealing member is formed as a separate member then is connected to the peripheral edge portion by means such as insertion, adhesion, deposition, or welding.

If the lid assembly of the container is closed in the compact of the above described configuration, the catch protrusion 10*a* at the tip of the catch piece 10 provided on the outer lid member 9 engages with the protuberant catch strip 6*a* of the outer frame member 2, to put the container in a sealed state, as shown in FIG. 1.

Simultaneously therewith, the annular compression protrusion portion 7*c* of the inner lid member 7 presses down on the upper surface of the skirt portion 8*b* of the sealing member 8, which projects further outward than the outer peripheral edge of the flange portion 4*a* provided around the peripheral edge of the inner dish 4, as can be seen from FIG. 5. Thus the skirt portion 8*b* is pressed downward and bends slightly in a resilient manner and, at the same time, the annular peripheral wall portion 7*b* of the inner lid member 7 adheres to the outer surface of the extreme edge portion 8*c* of the sealing member 8, so that the inner-dish portion containing the cosmetic substance is placed in a doubly sealed state, and thus airtightness is ensured.

In this manner, when the lids of the compact of this invention are closed, the annular airtight contact portion due to the annular compression protrusion portion 7*c* of the inner lid member 7 and the annular airtight contact portion due to the annular peripheral wall portion 7*b* thereof are formed as two parallel strips to create a double sealing structure.

The compact of the present invention therefore ensures that the volatile components of the cosmetic substance accommodated within the inner dish do not evaporate and thus the reliability of the airtight seal is greatly increased, provided the two airtight contact portions do not fail simultaneously.

When the lid assembly of the compact of the present invention is closed, no components such as the lid members or the sealing member intrude into the inner dish portion that contains the cosmetic substance, so that the quantity of cosmetic substance that is contained in the inner dish is not limited.

Effects of the Invention

To release the lid assembly of the container of this invention, the engagement between the outer lid member and the main container member is released simply by pressing on the release-activating piece of the outer lid member, then the inner lid member is released by pushing the outer lid member upward, so that the operation of releasing the two lid members can be achieved rapidly by a simple operation involving gentle pressure by the finger tips of one hand.

An annular compression protrusion portion and an annular peripheral wall portion are provided on the inner lid member of the lid assembly and also the sealing member is fixed to the peripheral edge portion of the opening of the inner dish, so that, when the lids are closed, the annular compression protrusion portion of the inner lid member presses against the upper surface of the sealing member and, at the same time, the annular peripheral wall portion of the inner lid member presses against the outer side surface of the extreme edge of the sealing member. The resultant airtight contact portions enable the formation of a double sealing structure, making it possible to increase the reliability with which the airtightness is maintained, and also enabling the useful effect of not limiting the quantity of cosmetic substance stored in the inner dish.

The configuration is such that the inner dish can be fitted into and fixed to the inner frame member because the lower edge portion of the sealing member, which is formed of a resilient material, is attached to the outer side surface of the inner dish. Thus, in addition to the function of sealing the inner dish in cooperation with the lid assembly, the sealing member also has the function of connecting the inner dish and the inner frame member, making it easier to assemble the compact in comparison with a configuration in which the inner dish is fitted directly into the inner frame member, even when the fabrication precision of the inner frame member and the inner dish are reduced. This has the useful effect of enabling further cost reductions in the finished product.

We claim:

1. In an airtight compact for a cosmetic substance, a main container member is formed such that an inner frame member, which has a storage portion for a cosmetic implement and an accommodation portion for an inner dish, is fitted and fixed within a outer frame member, where said outer frame member has a shallow container shape in which is formed a catch wall provided with a protuberant catch strip on an upper edge portion of a front surface wall, which engages with an outer lid member, and a sliding surface below said front side surface along which a release-activating piece is made to slide; an inner dish, which is provided with a resilient sealing member at a peripheral edge portion of an opening thereof, is fitted firmly into said inner-dish accommodation portion of said inner frame member; a lid assembly is formed such that an inner side of said outer lid member is integrally provided with an inner lid member for sealing said inner dish, where said inner lid member is formed with a catch protrusion on a front edge portion thereof and a hinge for connection to said outer frame member on a rear edge portion thereof, said hinge being connected to said outer frame member at a rear portion in such a manner that said lid assembly is linked in a freely openable manner to a rear edge portion of said outer frame member of said main container member; a catch piece is disposed perpendicularly at a front edge portion of said outer lid member and is provided with a catch protrusion that engages with said protuberant catch strip of said outer frame member, and also a hook piece is disposed perpendicularly on an inner surface of a central portion thereof so as to engage with said catch protrusion of said inner lid member; and said release-activating piece at said front edge portion of said outer lid member is attached thereto in a rotational manner; whereby said lid assembly of said airtight compact can be released by pressure on said release-activating piece.

2. The airtight compact for a cosmetic as defined in claim 1, wherein: an annular resilient sealing member that is fixed to said peripheral edge portion of said opening of said inner dish is formed to have a substantially T-shaped cross-section in which is formed a skirt portion that is positioned above a horizontal portion of said inner frame member, an extreme edge portion thereof is formed to curve obliquely downward, and a vertical piece is formed on a lower surface of said skirt portion.

3. The airtight compact for a cosmetic as defined in claim 1, wherein: an annular resilient sealing member that is fixed to said peripheral edge portion of said opening of said inner dish is formed to have a skirt portion that is positioned above a horizontal portion of said inner frame member, an extreme edge portion thereof is formed to curve obliquely downward, a vertical piece is formed on a lower surface of said skirt portion, and also a protuberant engagement portion is formed to extend from a lower edge portion of said vertical piece.

4. The airtight compact for a cosmetic as defined in claim 1, wherein: an annular resilient sealing member that is fixed to said peripheral edge portion of said opening of said inner dish is formed to have a skirt portion that is positioned above a horizontal portion of said inner frame member, an extreme edge portion thereof is formed to curve obliquely downward, and a vertical piece is formed on a lower surface of said skirt portion, where said vertical piece has a protrusion projecting from a base portion thereof and a protuberant engagement portion is provided extending from a lower edge surface.

5. The airtight compact for a cosmetic as defined in claim 1, wherein: a step portion is formed at an intersection between a horizontal portion and a vertical portion of said inner-dish accommodation portion of said inner frame member, and said inner dish is installed therein in such a manner that a vertical piece of an annular resilient sealing member that is provided at a peripheral portion of an opening of said inner dish engages with said step portion.

6. The airtight compact for a cosmetic as defined in claim 1, wherein: a step portion is formed at an intersection between a horizontal portion and a vertical portion of said inner-dish accommodation portion of said inner frame member, a plurality of catch protrusions for holding said inner dish are formed on an inner peripheral surface of said vertical portion, and said inner dish is installed therein in such a manner that a vertical piece of an annular resilient sealing member that is provided at a peripheral portion of an opening of said inner dish engages with said step portion, and said protuberant engagement portions of said resilient sealing member engage with said catch protrusions.

7. The airtight compact for a cosmetic as defined in claim 1, wherein: a step portion is formed at an intersection between a horizontal portion and a vertical portion of said inner-dish accommodation portion of said inner frame member, a plurality of catch protrusions are formed on an inner peripheral surface of said vertical portion, an annular seating is formed protruding from said horizontal portion on an outer side of said step portion, and said inner dish is installed therein in such a manner that a vertical piece of an annular resilient sealing member that is provided at a peripheral portion of an opening of said inner dish engages with said step portion, said protuberant engagement portions of said resilient sealing member engage with said catch protrusions, and a skirt portion of said resilient sealing member engages with said seating.

8. The airtight compact for a cosmetic as defined in claim 1, wherein: said inner lid member for closing the inner dish portion, which is provided on the inner side of said outer lid member, comprises a flat portion having a diameter slightly larger than an opening surface of said inner dish, an airtight compression portion formed of an annular peripheral wall portion extending downward from an outer edge portion of said flat portion and an annular compression protrusion portion provided on an inner side of said peripheral wall portion, and a catch protrusion on a front upper portion of said peripheral wall portion for engaging with a hook piece of said outer lid member, such that sealing is performed by said airtight compression portion of said resilient sealing member when said lid members are closed.

9. The airtight compact for a cosmetic as defined in claim 1, wherein: a space portion is formed between an annular seating and a skirt portion that is positioned on said annular seating, where said skirt portion is provided protruding from a horizontal portion of said inner frame member of said resilient sealing member that is fixed to said peripheral edge portion of said opening of said inner dish, for allowing said skirt portion to bend downward; and said inner lid member is provided with an annular compression protrusion for adhering to an upper surface of said skirt portion and an annular peripheral wall portion for pincering an extreme edge portion of said skirt portion against said seating provided in said inner frame member, whereby a sealing state is ensured by double compression of said sealing member.

10. The airtight compact for a cosmetic as defined in claim 1, wherein: an annular flange portion is formed around an outer peripheral edge of said opening of said inner dish that is installed into said inner-dish accommodation portion of said inner frame member that is fitted and fixed into said outer frame member of said main container member, an annular projection portion is formed on an upper surface of said flange portion, an annular resilient sealing member is fixed onto an upper surface of said flange portion, and a resilient sealing member provided with a skirt portion projecting annularly outward from said peripheral edge portion of said opening of said inner dish is fixed to: such that, in a state in which a base portion of said sealing member is fitted between a protruding portion of said flange portion and said peripheral edge portion of said opening, a skirt-shaped outer peripheral portion is provided extending outward from said base portion and an extreme edge portion thereof is provided bending downward.

11. The airtight compact for a cosmetic as defined in claim 10, wherein: a space portion is formed between an extreme edge portion of said sealing member and an upper surface of said inner frame member, formed to enable an extreme edge portion of said sealing member to bend slightly downward and also permit a skirt portion thereof to bend downward, whereby a sealing state is ensured by double compression of said sealing member by an annular compression protrusion portion and an annular wall portion that adhere to an upper surface of said skirt portion.

* * * * *